US005226301A

United States Patent [19]

Rizzetto et al.

[11] Patent Number: 5,226,301

[45] Date of Patent: Jul. 13, 1993

[54] ARRANGEMENT FOR DISPENSING LIQUID DETERGENTS AND/OR RINSE AIDS IN A WASHING MACHINE

[75] Inventors: Pietro Rizzetto, Venezia; Giuseppe Cargnel, Treviso, both of Italy

[73] Assignee: Zanussi Elettrodomestici S.p.A., Pordenone, Italy

[21] Appl. No.: 825,044

[22] Filed: Jan. 24, 1992

[30] Foreign Application Priority Data

Feb. 18, 1991 [IT] Italy ..... PN91 U 000002

[51] Int. Cl.[5] ..... D06F 39/02

[52] U.S. Cl. ..... 68/17 R; 251/149.6

[58] Field of Search ..... 68/17 R; 134/99.2; 222/372; 251/149.6

[56] References Cited

U.S. PATENT DOCUMENTS

| | | | |
|---|---|---|---|
| 1,767,391 | 6/1930 | Muller | 251/149.6 |
| 2,905,485 | 9/1959 | Zajac | 251/149.6 |
| 3,074,596 | 1/1963 | Marchi | 68/17 R X |
| 4,390,160 | 6/1983 | Reed | 251/149.6 |
| 4,757,919 | 7/1988 | Smazik et al. | 251/149.6 X |
| 4,991,820 | 2/1991 | Kohn et al. | 251/149.6 X |
| 5,046,336 | 9/1991 | Ferguson et al. | 68/17 R |

FOREIGN PATENT DOCUMENTS 3246127 6/1984 Fed. Rep. of Germany ..... 68/17 R

*Primary Examiner*—Philip R. Coe

*Attorney, Agent, or Firm*—Pearne, Gordon, McCoy & Granger

[57] ABSTRACT

A dispenser for washing machines, in particular clothes washing machines or combined clothes washing and drying machines. The dispenser includes first and second rigid conduits (12, 13) extending orthogonally with respect to each other. The first is connected with a sealed enclosure (8) containing the liquid detergents and/or rinse aids. The second is connected with a quick-fitting coupler (25) that is adapted to be connected and disconnected with respect to a further rigid conduit (28) communicating with the wash tub of the washing machine through a positive-displacement pump. The second rigid conduit (13) is associated with a check valve (32) that is biased by a spring (42) to move from a first to a second position, whereby a communication is therefore established or discontinued between the enclosure (8) and its outer space when the second rigid conduit (13) is engaged and disengaged, respectively, with respect to said quick-fitting coupling means (25). The dispensing arrangement can quickly and easily be installed in and removed from washing machines of the aforementioned type.

8 Claims, 5 Drawing Sheets

ARRANGEMENT FOR DISPENSING LIQUID DETERGENTS AND/OR RINSE AIDS IN A WASHING MACHINE

DESCRIPTION

The invention relates to an arrangement for dispensing liquid detergents and/or rinse aids in a washing machine, in particular a clothes washing machine or a combined clothes washing and drying machine, which is conceived so as to enable it to be easily and quickly assembled into and disassembled out of said washing machine.

Liquid detergent and/or rinse aid dispensers of this kind are already known in the prior art, each one of them comprising a throw-away enclosure of an elastically deformable material, preferably plastics, that is sized to hold such a volume of liquid detergent and/or rinse aid as it is necessary to enable several clothes washing processes to be performed by the machine, and is further provided with a flexible conduit tightly inserted through a corresponding sealing cap of the enclosure, said conduit penetrating so far into the enclosure as to almost reach its bottom, so as to be able to suck the liquid detergent and/or rinse aid contained therein under the action of a corresponding positive-displacement pump of a traditional type installed in the lower portion of the machine, thereby transferring said liquid detergent and/or rinse aid into the wash tub of said washing machine.

Each enclosure, which will have been previously vacuum filled with a corresponding amount of liquid detergent and/or rinse aid, is then removably mounted into a corresponding seat obtained in the front-side lower portion of the cabinet of the washing machine, by having it positioned in such a way as to enable its sealing cap to be reached through an appropriately provided removable front panel of the same washing machine and manually connecting the respective free ends of said flexible conduit and a further provided flexible conduit with each other, said further provided flexible conduit having been previously connected with the suction gate of the related positive-displacement pump, which in turn communicates through a further conduit with the wash tub of the washing machine.

This kind of connection of each detergent dispenser of this type, if it on the one hand enables the liquid detergent and/or rinse aid therein contained to be most effectively transferred into the wash tub of the washing machine owing to the capability of the material of the enclosure of the dispenser itself to temporarily get elastically deformed, turns on the other hand out to be difficult, rather unconvenient and unpractical to implement, since it requires various operations to be performed to carry it out and to install said dispenser in its working position.

It is therefore the purpose of the present invention to overcome the afore described drawbacks of currently used dispensers by providing a liquid detergent and/or rinse aid dispenser arrangement which is specially conceived so as to enable it to be most easily and quickly connected to, installed in and removed from a washing machine of the afore cited kind.

Said liquid detergent and/or rinse aid dispenser arrangement is provided with the characteristics and features as essentially described with particular reference to the appended claims.

BRIEF DESCRIPTION OF THE DRAWINGS

The invention will be further described by way of nonlimiting example with reference to the accompanying drawings in which.

DETAILED DESCRIPTION OF THE PREFERRED EMBODIMENT

Figure 1:
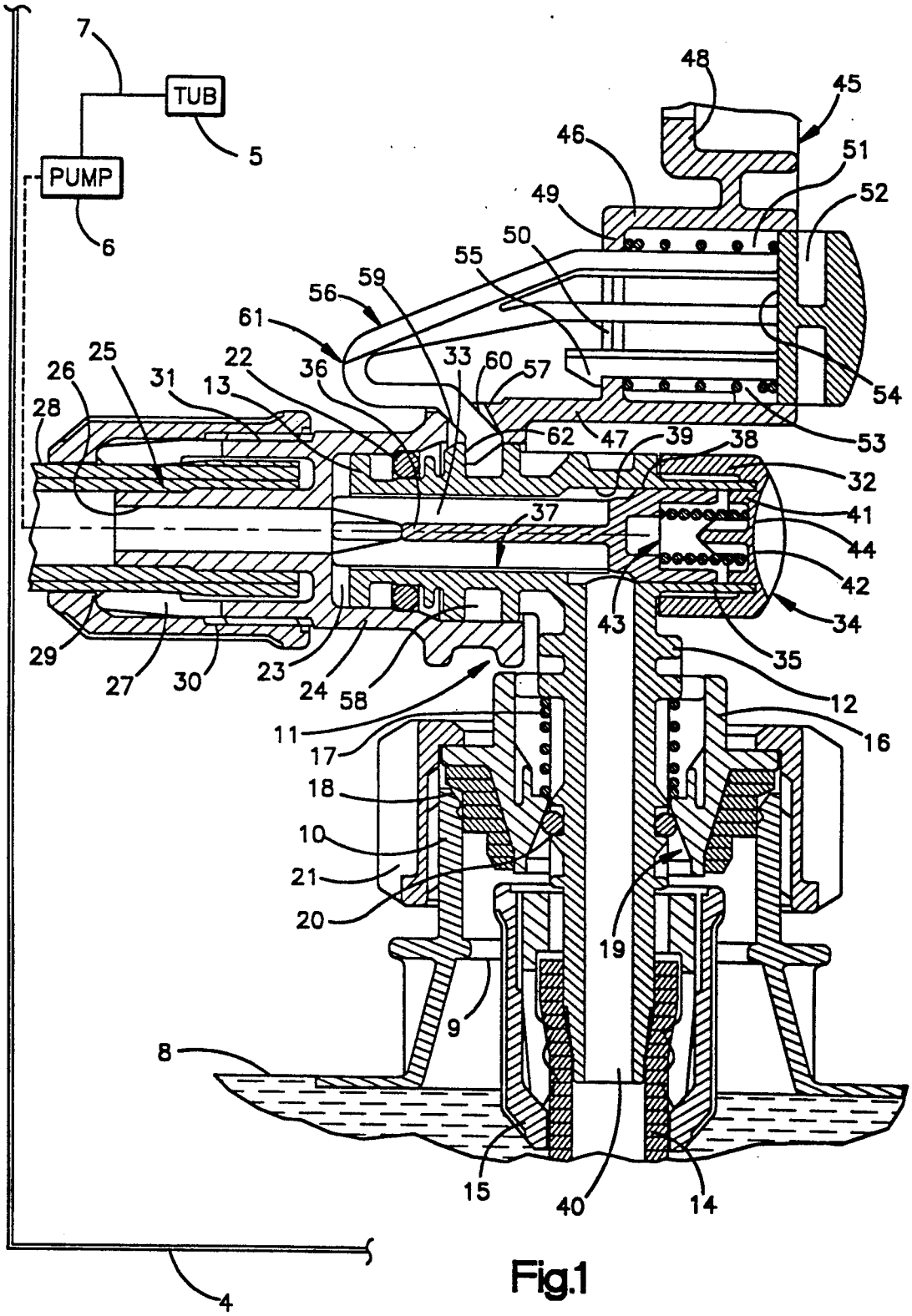
FIG. 1 is a front view of the dispenser arrangement assembly according to the present invention.

FIG. 1 schematically illustrates the liquid detergent and/or rinse aid dispensing arrangement according to the invention, which is normally installed in a removable manner in the lower front portion of a metal cabinet 4 of a washing machine, in particular a clothes washing machine or a combined clothes washing and drying machine, so as to cause said liquid detergents and/or rinse aids to be transferred from their container into a wash tub 5 of the washing machine as required by the washing processes being from time to time performed according to the user's selections.

As it can be seen in this Figure, the liquid detergent and/or rinse aid dispensing arrangement essentially comprises at least an entirely enclosed throw-away enclosure 8 made of an elastically deformable material, preferably plastics, which is in its upper portion provided with a circular opening 9 intended for filling in and dispensing out liquid detergents and/or rinse aids in such amounts as to enable several clothes washing processes to be performed out of a filling of the enclosure, said circular opening 9 fitting together with a corresponding circular inlet opening 10, and it further comprises a single-piece body 11 consisting of two rigid conduits 12 and 13 of plastic material extending in orthogonal direction with respect to each other, of which the conduit 12 is inserted with its free end in a corresponding flexible conduit 14 of plastic material, said flexible conduit 14 being open at both its ends, while the assembly formed by said conduits 12 and 14 is then inserted into the enclosure 8 through the inlet opening 10 and the opening 9, in such a way that the flexible conduit 14 is pushed down until it reaches a point very close to the bottom of said enclosure and is therefore able to totally suck in the liquid detergents and/or rinse aids contained in the same enclosure.

Furthermore, the rigid conduit 12 is provided with external radially arranged ribs that are shaped in such a way as to be able to house a ring nut 15 and a retaining collar 16 arranged so as to be capable of sliding along the same conduit, of which the ring nut 15 is slipped on the assembly formed by the conduits 12 and 14 and the collar 16 is internally provided with an extension spring 17 abutting against the same collar and an adjacent rib of the rigid conduit 12, as well as externally provided with a sealing gasket 18 and an internal flared surface 19 that is capable of abutting against a sealing ring 20 being housed between two adjacent ribs of the rigid conduit 12.

The purpose of said extension spring 17 is to axially load the collar 16 by manual action, in such a way as to force its flared surface 19 away from the sealing ring 20 and enable in this way the air to evacuate from inside the enclosure 8.

The single-piece body 11 is locked in position against the inlet opening 10 of the throw-away enclosure 8 by means of a further ring nut 21, which is sized so as to be able to engage around the retaining collar 16 and internally threaded so as to be able to be screwed and unscrewed around a corresponding threading of the inlet opening 10. Under the circumstance, said ring nut 21 causes then also the rigid conduit 12 to be axially displaced to a limited extent and, therefore, said sealing gasket 18 to be compressed against the outer border of the inlet opening 10 and, since said internal flared surface 19 of said retaining collar turns out to be already compressed against the sealing ring 20, against the action of the extension spring 17, it therefore ensues that the liquid detergents and/or rinse aids being sucked from inside the enclosure 8, and flowing through the flexible conduit 14, are effectively prevented from seeping outside therethrough.

The rigid conduit 13 of the single-piece body 11 is in turn also provided of external radially arranged ribs, which are shaped in such a way as to be capable of being inserted in an axial direction under a slight pressure, upon interposition of a sealing ring 22 provided to prevent liquids from seeping outside therethrough and housed within as corresponding external seat in the rigid conduit 13, into a corresponding recess 23 in the circular bushing 24 of a quick-fitting coupling means 25, which is provided at its free end with a slightly tapered shank 26 and a plurality of elastic projecting members 27 that are capable of opening apart so as to bring about a gripping effect and are distributed all around said shank 26. The quick-fitting coupling means 25 resulting therefrom is then removably connected to the terminal portion of a further rigid conduit 28 which is fixed in the lower front portion of the cabinet of the washing machine, said conduit 28 being provided with a connection ring nut 29 slidably mounted thereon and being further connected with its other terminal portion to the suction side of a positive-displacement pump 6 or other similar liquid pumping device, which is in turn connected through a further conduit 7 with the wash tub of the washing machine involved.

In particular, this connection is achieved by fully inserting the shank 26 of said quick-fitting coupling means 25 in the corresponding inlet opening of the rigid conduit 28 and by letting said elastic projecting members 27 engage onto the outer surface of said rigid conduit, as well as by finally letting the connection ring nut 29 slide upon said elastic projecting members so as to enable the internal threaded portion 30 of the ring nut 29 to be fully screwed and tightened on the corresponding external threaded portion 31 of the bushing 24.

In any washing machine which is arranged and provided in the afore described way the liquid detergent and/or rinse aid dispensing arrangement according to the present invention, the single component parts thereof having been duly pre-assembled, can therefore be removably and quickly installed and attached through a simple insertion of the rigid conduit 13 of the single-piece body 11 in the recess 23 of the bushing 24 of the quick-fitting coupling means 25.

The liquid detergent and/or rinse aid dispensing arrangement according to the present invention is further provided with a check valve 32 which is capable of putting the inside of the enclosure 8 in communication with the outside atmosphere, as well as cutting off this communication, and comprises an elongated stem 33 and a cylindrical plug 34 which is coaxial therewith and is shrink-fitted onto a corresponding circular projection 35 that is coaxial with the rigid conduit 13.

In particular, said elongated stem 33 is provided with a plurality of lengthwise extending ribs 36 that blend into each other, and define between them channel-like recessed zones for the passage of liquids, and is adapted to slide along the internal through-hole 37 of the rigid conduit 13, said stem joining further together with an enlarged circular head 38 slidably adaptable into a corresponding cylindrical hole 39 in the rigid conduit 13 having a larger diameter than the afore mentioned hole 37 and communicating with the latter, as well as passing also through said circular projection 35, said cylindrical hole 39 orthogonally communicating also with the cylindrical hole 40 drilled through the rigid conduit 12.

A circular open recess 41 is provided in said circular head 38, which recess houses a compression spring 42 whose end extremities abut against a corresponding seat 43 of said recess and against the bottom wall 44 of the plug 34, respectively. When operated as described hereinafter, the check valve 32 resulting therefrom is adapted to slide along the holes 37 and 39 in the rigid conduit 13, in such a way as to be able to shift into two different operating positions, i.e. respectively into a first position in which the head 38 of the valve is pushed close to the bottom wall 44 of the plug 34, thereby compressing the spring 42 between said two parts and putting the holes 37 and 39 of the rigid conduit 13 in communication with the hole 40 of the rigid conduit 12, and into a second position in which said head 38 is shifted away from said bottom wall 44, thereby keeping said spring 42 relieved and breaking off the communication between said holes 37, 39 and 40.

The liquid detergent and/or rinse aid dispensing arrangement according to the present invention also comprises an attachment and release mechanism 45 arranged in close vicinity of the single-piece body 11 and rigidly applied in the lower front portion of the washing machine, so as to enable said single-piece body of the dispensing arrangement to be easily and quickly fitted and released with respect to said quick-fitting coupling means 25.

Said attachment and release mechanism essentially comprises a cylindrical hollow case 46, which is connected through a rectilinear wall 47 with the afore cited cylindrical bushing 24 and is sustained by a plastic support means 48 fixed in the lower front portion of the cabinet of the washing machine, said cylindrical hollow case being frontally open and provided with a rear wall 49 with related through-hole 50.

In the internal cavity 51 of said cylindrical hollow case 46 there is slidably inserted a corresponding cylindrical push-button 52, which is loaded by a compression spring 53 placed between the rear wall 54 of the same push-button and said rear wall 49 of the cylindrical hollow case, so as it can be shifted from a position in which it is projecting from said case, when said spring 53 is relieved, to a position in which it on the contrary is practically flush with the front edge of said cylindrical hollow case when said spring 53 is fully compressed.

Furthermore, this push-button 52 is connected with at least one detent 55 passing through the hole 50 in the rear wall 49 of said cylindrical hollow case 46 and engaging externally against said rear wall, as well as with an elongated elastic tongue 56 that is appropriately bent so that it can penetrate with its free end into a corresponding through-passing opening 57 made in said rectilinear wall 47, thereby engaging for the reasons described hereinafter with a corresponding peripheral groove 58 resulting between two adjacent external ribs of the rigid conduit 13 when this conduit is inserted in the cavity 23 of the circular bushing 24.

In view of facilitating the penetration of said tongue 56 in the through-passing opening 57, the free end of said tongue is provided with flat, mutually parallel surfaces 59 and 60, which blend into a bent portion 61 of said tongue, as well as into a rounded terminal edge 62, whereas said through-passing opening 57 has in turn its opposite edges 63 and 64 that are respectively rounded and appropriately inclined with respect to the direction along which the wall 47 is extending.

Figure 2:
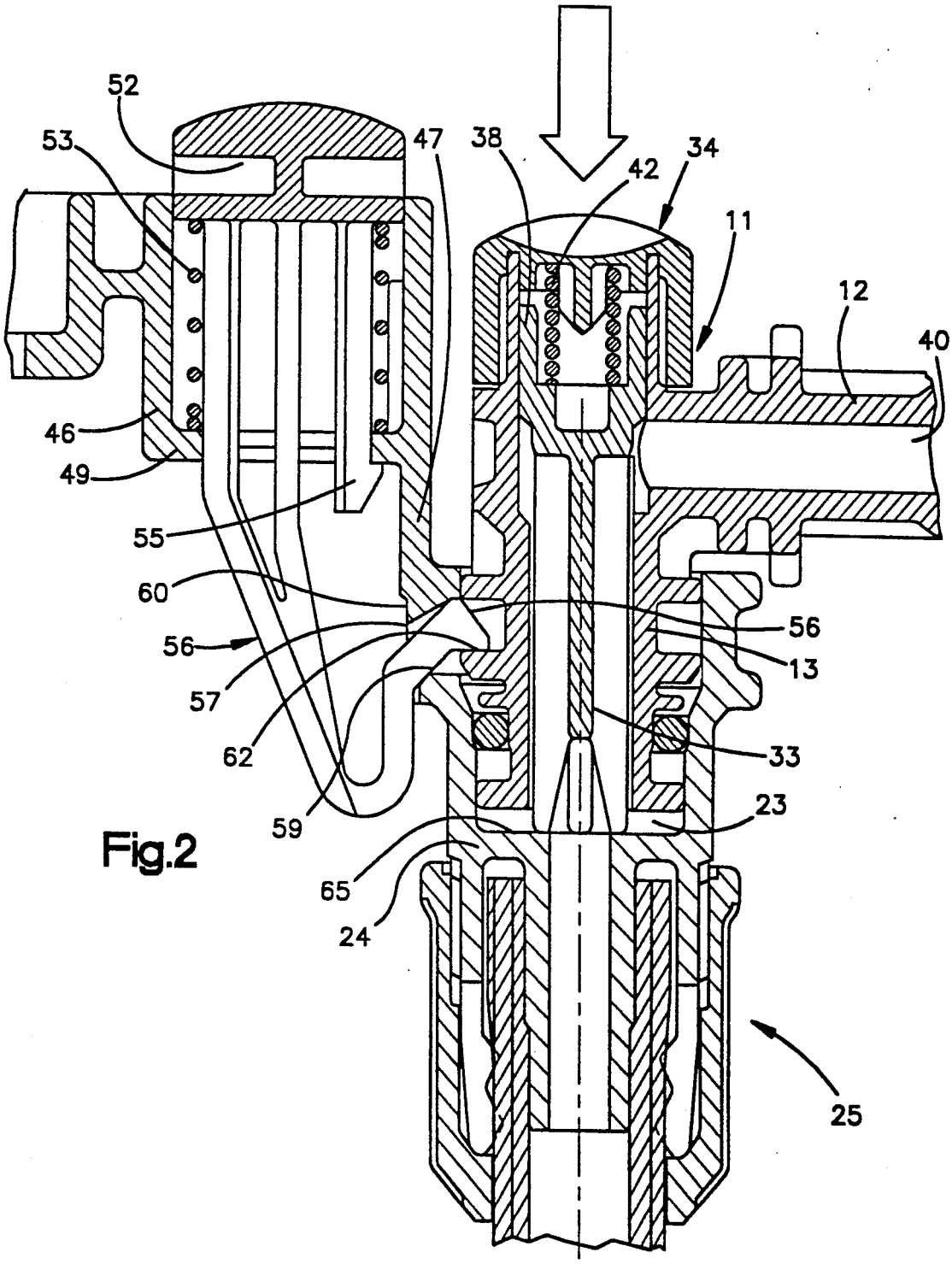
FIGS. 2 and 3 are front views of two partially cross-sectioned construction details of the dispenser arrangement assembly according to FIG. 1.

Referring now to FIG. 2, it can be noticed that it shows the liquid detergent and/or rinse aid dispensing arrangement according to the present invention with its single-piece body 11 which is shifted into its attachment position with respect to the quick-fitting coupling means 25.

As it can be inferred from this Figure, this is achieved by first of all inserting the free end of said tongue 56 of said push-button 52 in the through-passing opening 57 and then pushing the rigid conduit 13 of said single-piece body 11 into the cavity 23 of the circular bushing 24 of said quick-fitting coupling means 25 until said free end of the tongue 56 engages with its terminal edge 62 in the peripheral groove 58 of said rigid conduit 13, thereby locking it in position.

Under such a condition, the free end of the elongated stem 33 of the check valve 32 comes then to abut against the bottom wall 65 of said circular bushing 24, thereby causing the same stem and the valve head 38 connected thereto to shift toward the cylindrical plug 34 and, therefore, the spring 42 to be compressed between said plug 34 and said head 38, and putting in this way the holes 37 and 39 of the rigid conduit 13 in communication with the hole 40 of the rigid conduit 12.

The push-button 52, in turn, is not actuated under the above described condition, and it is kept by the spring 53 in a position in which it is projecting from the cylindrical hollow case 46 and the detent 55 connected to that push-button engages against the rear wall 49 of the same cylindrical hollow case, thereby preventing said push-button from moving any further.

In this way, when the positive-displacement pump of the washing machine is switched on by the timer-programme sequence control switch of the same machine, said pump causes the liquid detergents and/or rinse aids contained in the enclosure 8 to be sucked off that enclosure and be delivered into the wash tub of the washing machine through the flexible conduit 14 and the holes 40, 39, 37 of the respective rigid conduits 12 and 13.

Figure 3:
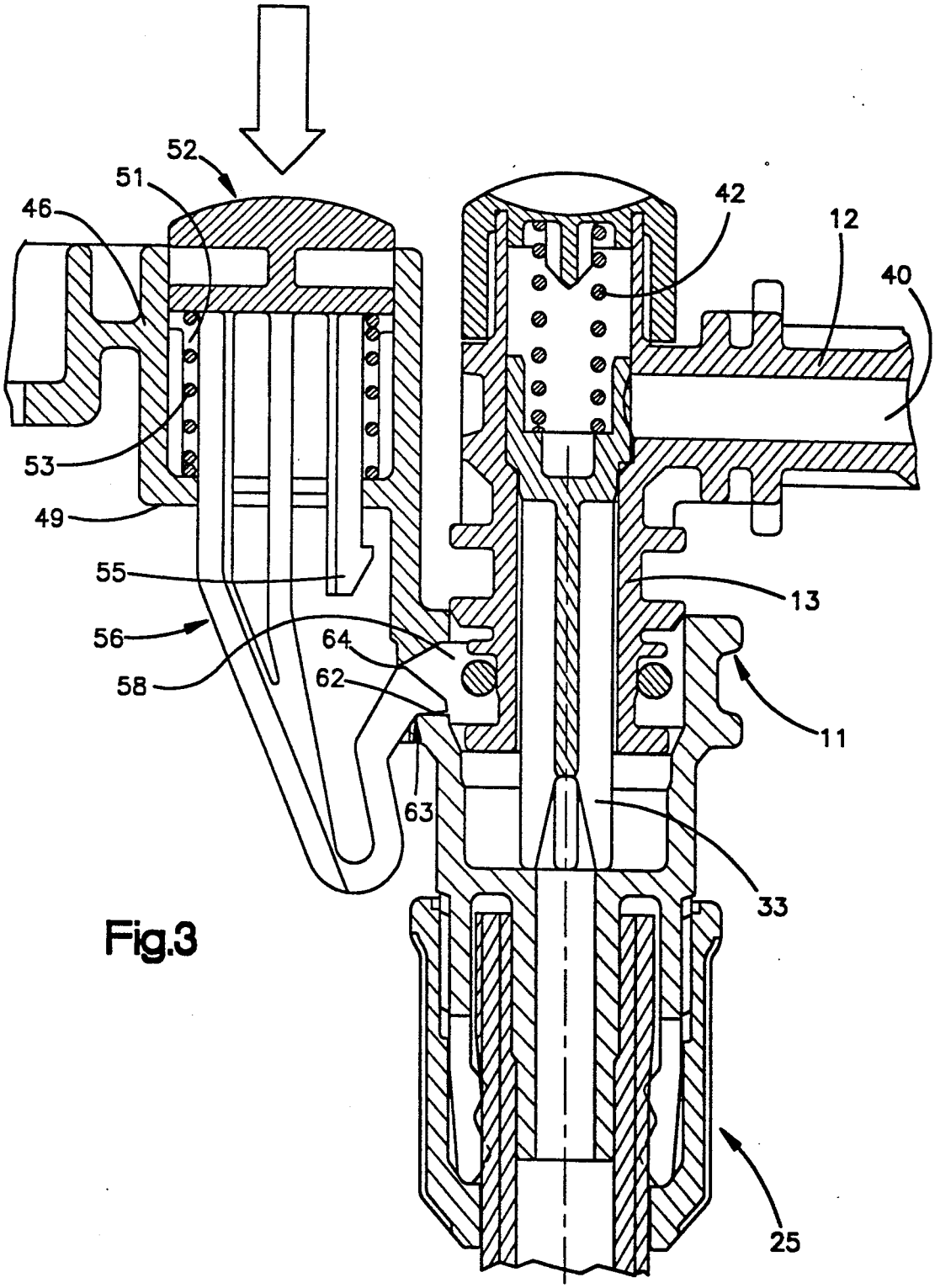

Referring now to FIG. 3, it can be noticed that it shows the liquid detergent and/or rinse aid dispensing arrangement according to the present invention when its single-piece body 11, that has previously been inserted in the quick-fitting coupling means 25 as described above, is released from said quick-fitting coupling.

As it can be inferred from said Figure, such a release operation is performed by pushing the corresponding push-button 52 toward the inner cavity 51 of the cylindrical hollow case 46 against the action of the spring 53, which thing at the same time causes the detent 55 to disengage from the rear wall 49 of said cylindrical hollow case and the elastic tongue 56 to be shifted to such an extent as to cause the free end of said tongue to be progressively pulled out of the peripheral groove 58 in the rigid conduit 13, by sliding through said through-passing opening 57 in the rectilinear wall 47.

When said free end of the elastic tongue 56 is pulled fully out of said peripheral groove 58 and reaches the position shown in FIG. 3, in which the rounded terminal edge 62 of said elastic tongue engages with the opposing rounded edge 63 of said through-passing opening 57, thereby preventing said tongue from slipping fully off, and in which said push-button 52 is no longer pushed toward the inner cavity 51 of said cylindrical hollow case 46, so that the spring 53 reverts to its relieved state and the detent 55 engages again with the rear wall 49 of said cylindrical hollow case, even the spring 42 reverts to its relieved state and causes in this way both the check valve 32 to be shifted, so that its head 38 moves to a position in correspondence of the hole 40 of the rigid conduit 12, thereby discontinuing the communication between the latter and the holes 37 and 39 of the rigid conduit 13, and the single-piece body 11 to be displaced so that it releases from the quick-fitting coupling means 25 and moves frontally apart from said quick-fitting coupling.

Under these circumstances, the single-piece body 11 turns then out to be separated from said quick-fitting coupling means 25 so as to prevent liquid detergents and/or rinse aids from being added into the wash tub of the washing machine and to enable the enclosure 8 containing said liquid detergents and/or rinse aids, and connected to said single-piece body 11, to be re-filled with additional amounts of liquid detergents and/or rinse aids, or even to enable the liquid detergent and/or rinse aid dispensing arrangement itself to undergo regular maintenance or servicing, whereas said enclosure 8 is in all cases kept tightly closed by said displacement of the check value 32 into the above described position.

Upon completion of said re-filling or maintenance operations, said single-piece body 11 is for the same afore described reasons attached again to said quick-fitting coupling means 25 as it was before being released, by letting the ribs of the rigid conduit 13 slide on the free end of the elastic tongue 56, which is again inserted in the through-passing opening 57 in the rectilinear wall 47, whereas that sliding movement is facilitated by the special inclination featured by said free end.

Figure 4:
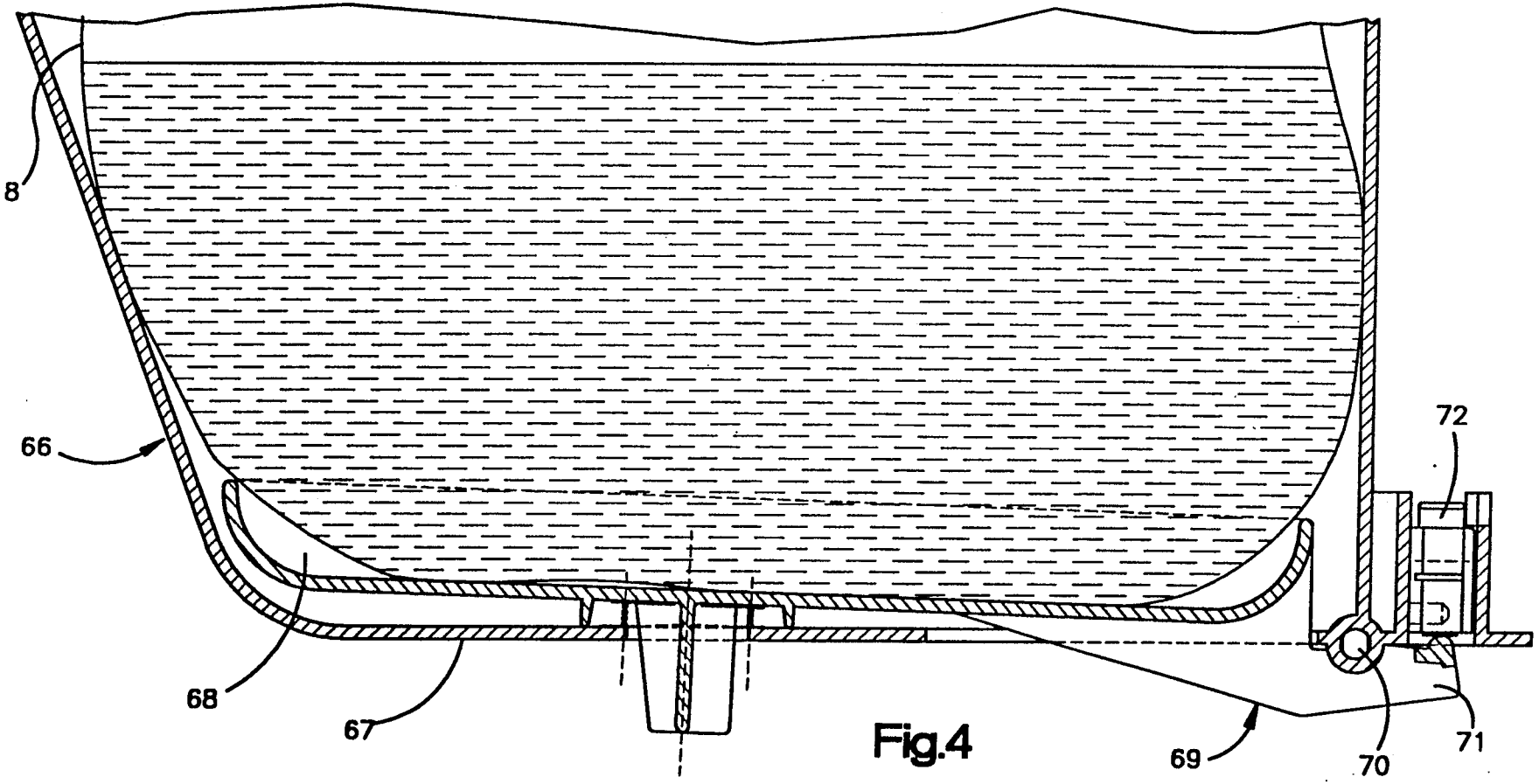
FIGS. 4 and 5 are front views of a further lengthwise sectioned construction detail of the dispenser arrangement assembly according to FIG. 1, as shifted in two different operating positions.
Figure 5:
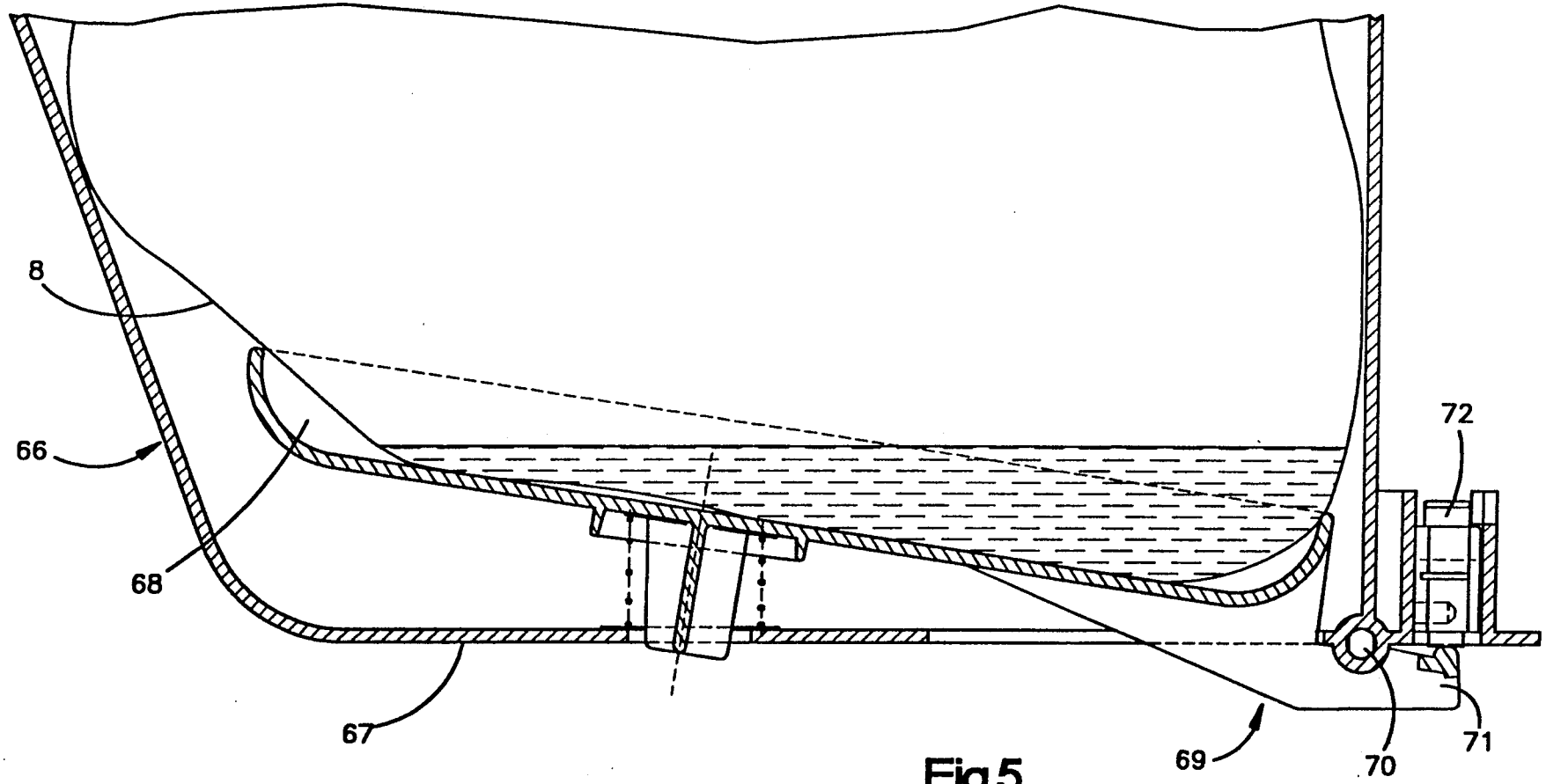

Referring finally to the FIGS. 4 and 5, it can be noticed that they schematically show a box-like shaped container 66 installed in the lower front portion of the washing machine, the bottom 67 of which is appropriately perforated so as to enable a hollow plate 68, on which the enclosure 8 containing the liquid detergents and/or rinse aids to be dispersed is resting, and to the lower portion of which a lever 69 being pivotally hinged about the stud 70 housed in the lower portion of the same container, to be shifted in two different operating positions, said lever 69 having its free arm 71 interacting with a microswitch 72 or similar device connected to the electrical circuit of the washing machine, in such a way that it causes said microswitch to be actuated in either its making or breaking position in accordance with the particular position into which said hollow plate 68 is shifted.

In particular, FIG. 4 shows said hollow plate 68 when it is fully lowered due to the heavier weight of the enclosure 8 filled with liquid detergent and/or rinse aid resting on it. In this case, then, said hollow plate 68 causes the lever 69 to be shifted in such a way that the free arm 71 of the same lever actuates the microswitch 72 to make the circuit, thereby signalling through a corresponding optical (or acoustical) indicator of a per se known type (not shown) that there is such supply of said liquid detergents and/or rinse aids in said enclosure 8 and enabling the washing processes selected by the user to be regularly performed by the washing machine.

FIG. 5 shows on the contrary said hollow plate 68 when it is lifted in a position which is higher than the formerly described one since said enclosure 8 has a lower weight due to the fact that it contains a smaller quantity, or even no quantity at all, of said liquid detergents and/or rinse aids as they are progressively sucked in and delivered to the wash tub of the washing machine by the specially provided positive-displacement pump.

In this case, said hollow plate 68 causes then the lever 69 to be shifted in such a way that the free arm 71 of the same lever actuates the microswitch 72 to break the circuit, thereby signalling through said optical or acoustical indicator that there is such a short supply, or no supply at all, of said liquid detergents and/or rinse aids in said enclosure 8, which shall therefore be duly refilled with appropriate additional quantities of liquid detergents and/or rinse aids.

In this way it is possible to readily identify the filling state of said enclosure 8, i.e. readily appreciate if the detergent and/or rinse aid supply in that enclosure is sufficient or if the enclosure itself needs re-filling, whereas the upper and lower limits of weight of the enclosure containing said liquid detergent and/or rinse aid supplies will have been appropriately predetermined so as to have these limits duly signalled by the microprocessor 72 being actuated into its two operating positions as described afore.

The liquid detergent and/or rinse aid dispensing arrangement made in the afore described way proves to be very convenient and practical to use and can be easily and quickly installed in and removed from washing machines of the afore cited kind, whereas it enables liquid detergents and/or rinse aids to be effectively and efficiently dispensed into the wash tub of said washing machines.

We claim:

1. A liquid detergent and/or rinse aid dispensing arrangement for washing machines, in particular clothes washing machines or combined clothes washing and drying machines, comprising a wash tub supported within a cabinet; a sealed enclosure (s) containing the liquid detergents and/or rinse aids required for a clothes washing process to be performed in the machine a first conduit (14) in communication with said enclosure; an additional conduit (28) in communication with the first conduit; coupling means (25) disposed on the additional conduit (28); and suction means communicating with said wash tub and said enclosure through the additional conduit (28), so as to draw the liquid detergents and/or rinse aids from said sealed enclosure (8) and deliver them into said wash tub, characterized by connector means (11) connectable to and disconnectable from said sealed enclosure (8), said first conduit (14) and said coupling means (25); valve means (32) provided on said connector means, said connector means (11) operating said valve means (32) from a first operating position, in which said first conduit (14) and said additional conduit (28) communicate with each other, when said connector means (22) are connected to said coupling means (25), to a second operating position in which said first conduit (14) and said additional conduit (28) are not communicating with each other, when said connector means (11) are disconnected from said coupling means (25); and actuating means (45) provided on said connector means to enable said connector means (11) to be connected to and disconnected from said coupling means (25).

2. A liquid detergent and/or rinse aid dispensing means according to claim 1, characterized in that said connector means (11) comprise first and second rigid conduits (12, 13) each having a free end and extending orthogonally with respect to each other and provided with respective inner through-holes (40, 39, 37) that are communicating with each other; fastening means (15, 16, 21) and sealing means (18, 20) for removably connecting said first rigid conduit (12) at its free end with said sealed enclosure (8); and a circular bushing (24) on said coupling means (25) interposed with further sealing means (22) for removably connecting said second rigid conduit (13) at its free end with said first conduit (14).

3. A liquid detergent and/or rinse aid dispensing arrangement according to claim 2, characterized by a hollow plate (68) arranged in the lower front part of the washing machine, said sealed enclosure resting on said hollow plate; a lever (69) fixed to said plate (68); switching means (72) connected in an electric circuit of the washing machine and positioned to be actuated by said lever; and corresponding indicator means connected to said switching means, said hollow plate (68) being capable of being shifted, by the weight of the liquid detergents and/or rinse aids contained in said sealed enclosure (8), from a first to a second operating position in which said lever (69) causes said switching means (72) to be correspondingly actuated from a closed to an open position as signalled by said indicator means.

4. A liquid detergent and/or rinse aid dispensing arrangement according to claim 2, characterized in that said valve means (32) comprise an elongated stem (33); a plurality of lengthwise extending ribs (36) which blend into each other and define between them channel-like recessed zones provided on said stem; an enlarged circular head (38) connected to said stem; a circular projection (35) that is coaxial with said second rigid conduit (13); a cylindrical plug (34) fixed on said circular projection (35); and elastic means (42) mounted between said circular head and said cylindrical plug to bias said circular head, said stem (33) and said head (38) being able to be shifted along the through-holes (39, 37) of said second rigid conduit (13) to be moved from a first operating position, in which said head (38) compresses said elastic means (42) against said plug (34), thereby putting the respective through-holes (40, 39, 37) of said first and second rigid conduits (12, 13) in communication with each other, when said second rigid conduit (13) is connected to said coupling means (25), to a second operating position, in which said head (38) does not compress said elastic means (42) against plug (34), thereby discontinuing communication between said through-holes (40, 39, 37), when said second rigid conduit (13) is disconnected from said coupling means (25).

5. A liquid detergent and/or rinse aid dispensing arrangement according to claim, 4 characterized by a hollow plate (68) arranged in the lower front part of the washing machine, said sealed enclosure resting on said hollow plate; a lever (69) fixed to said plate (68); switching means (72) connected in an electric circuit of the washing machine and positioned to be actuated by said lever; and corresponding indicator means connected to said switching means, said hollow plate (68) being capable of being shifted, by the weight of the liquid detergents and/or rinse aids contained in said sealed enclosure (8), from a first to a second operating position in which said lever (69) causes said switching means (72) to be correspondingly actuated from a closed to an open position as signalled by said indicator means.

6. A liquid detergent and/or rinse aid dispensing arrangement according to claim 4, characterized in that said actuating means (45) comprise a cylindrical hollow case (46) having a rear wall (49); a rectilinear wall (47) provided with a through-passing opening (57) and connecting said hollow case with said circular bushing (24); a push-button (52) which is adapted to slide within said cylindrical hollow case (46); elastic means (53) biasing said push-button; a detent (55) connected with said push-button (52) and engageable against the rear wall (49) of said cylindrical hollow case and an elongated elastic tongue (56) connected with said push-button and appropriately bent so as to penetrate with its free end into said through-passing opening (57), said push-button (52) being movable from a first position, in which the free end of said tongue (56) penetrates a peripheral groove (58) of said second rigid conduit (13), when the latter is connected with said circular bushing (24), to a second position, against the action of said elastic means (53), in which the free end of said elastic tongue (56) disengages from said peripheral groove (58), when said second rigid conduit (13) is disconnected from said circular bushing (24).

7. A liquid detergent and/or rinse aid dispensing arrangement according to claim 6, characterized by a hollow plate (68) arranged in the lower front part of the washing machine, said sealed enclosure resting on said hollow plate; a lever (69) fixed to said plate (68); switching means (72) connected in an electric circuit of the washing machine and positioned to be actuated by said lever; and corresponding indicator means connected to said switching means, said hollow plate (68) being capable of being shifted, by the weight of the liquid detergents and/or rinse aids contained in said sealed enclosure (8), from a first to a second operating position in which said lever (69) causes said switching means (72) to be correspondingly actuated from a closed to an open position as signalled by said indicator means.

8. A liquid detergent and/or rinse aid dispensing arrangement according to claim 1, characterized by a hollow plate (68) arranged in the lower front part of the washing machine, said sealed enclosure resting on said hollow plate; a lever (69) fixed to said plate (68); switching means (72) connected in an electric circuit of the washing machine and positioned to be actuated by said lever; and corresponding indicator means connected to said switching means, said hollow plate (68) being capable of being shifted, by the weight of the liquid detergents and/or rinse aids contained in said sealed enclosure (8), from a first to a second operating position in which said lever (69) causes said switching means (72) to be correspondingly actuated from a closed to an open position as signalled by said indicator means.

* * * * *

UNITED STATES PATENT AND TRADEMARK OFFICE

CERTIFICATE OF CORRECTION

PATENT NO. : 5,226,301

DATED : July 13, 1993

INVENTOR(S) : Pietro Rizzetto and Giuseppe Cargnel

It is certified that error appears in the above-identified patent and that said Letters Patent is hereby corrected as shown below:

Column 6, line 53, delete "dispersed" and insert --dispensed--.

Column 7, claim 1, line 48, delete "(s)" and insert --(8)--

Column 8, claim 5, line 62, delete ", 4" and insert --4,--

Signed and Sealed this

Twelfth Day of April, 1994

Bruce Lehman

*Attest:*

BRUCE LEHMAN

*Commissioner of Patents and Trademarks*

*Attesting Officer*